US007922463B2

(12) United States Patent
Lee et al.

(10) Patent No.: US 7,922,463 B2
(45) Date of Patent: Apr. 12, 2011

(54) LINEAR COMPRESSOR

(75) Inventors: Jong Koo Lee, Kyungki-do (KR); Jin Taek Oh, Seoul (KR); Kwang Wook Kim, Inchun-si (KR); Min Chul Han, Kyungsangnam-do (KR); Gye Young Song, Seoul (KR); Hyung Pyo Yoon, Kyungsangnam-do (KR); Kwang Ha Suh, Kyungki-do (KR); Kyoung Seok Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 652 days.

(21) Appl. No.: 11/254,662

(22) Filed: Oct. 21, 2005

(65) Prior Publication Data

US 2006/0280630 A1 Dec. 14, 2006

(30) Foreign Application Priority Data

Jun. 9, 2005 (KR) ..... 10-2005-0049317

(51) Int. Cl.
*F04B 17/04* (2006.01)

(52) U.S. Cl. ..... 417/417

(58) Field of Classification Search ..... 417/417, 417/415, 416; 310/12–39
See application file for complete search history.

(56) References Cited

U.S. PATENT DOCUMENTS

| | | | | | |
|---|---|---|---|---|---|
| 2,623,469 | A | * | 12/1952 | Gray | 417/310 |
| 2,934,256 | A | * | 4/1960 | Lenning | 417/274 |
| 3,384,021 | A | * | 5/1968 | Perron | 417/417 |
| 3,463,196 | A | * | 8/1969 | Richardson | 138/96 R |
| 3,543,061 | A | * | 11/1970 | Wallace | 310/17 |
| 3,604,504 | A | * | 9/1971 | Kessler et al. | 165/46 |
| 3,799,448 | A | * | 3/1974 | Nozawa et al. | 239/321 |
| 3,818,727 | A | * | 6/1974 | Hadam et al. | 66/127 |
| 3,828,152 | A | * | 8/1974 | Charmeil et al. | 200/83 J |
| 3,988,901 | A | * | 11/1976 | Shelton et al. | 62/116 |
| 4,228,377 | A | * | 10/1980 | Kreuzer | 310/263 |
| 4,662,827 | A | * | 5/1987 | Wiernicki | 417/363 |
| 5,514,028 | A | * | 5/1996 | Ali et al. | 451/539 |
| 5,551,673 | A | * | 9/1996 | Furusawa et al. | 267/160 |
| 5,704,771 | A | * | 1/1998 | Fujisawa et al. | 417/417 |
| 5,899,672 | A | * | 5/1999 | Salamey | 417/418 |
| 6,346,806 | B1 | * | 2/2002 | Schabuble et al. | 324/207.14 |
| 6,960,068 | B1 | * | 11/2005 | McNaull | 417/423.1 |
| 2003/0037997 | A1 | * | 2/2003 | Sakata | 188/71.5 |
| 2004/0104076 | A1 | * | 6/2004 | Heo et al. | 184/6.16 |
| 2004/0208759 | A1 | * | 10/2004 | Hong | 417/410.1 |
| 2004/0245863 | A1 | * | 12/2004 | Hong et al. | 310/14 |
| 2005/0140216 | A1 | * | 6/2005 | Lee | 310/12 |
| 2006/0093496 | A1 | * | 5/2006 | Lee et al. | 417/417 |

* cited by examiner

FOREIGN PATENT DOCUMENTS

CN 1432107 A 7/2003

OTHER PUBLICATIONS

Author: Lee et al, PCT Publication No. WO03040561, Title: "Abrasion preventive structure of Reciprocating Compressor", Date: May 15, 2003.*

*Primary Examiner* — Devon C Kramer
*Assistant Examiner* — Dnyanesh Kasture
(74) *Attorney, Agent, or Firm* — Birch, Stewart, Kolasch & Birch, LLP

(57) ABSTRACT

Disclosed herein is a linear compressor wherein a compression unit, including a cylinder and a linear motor, is supported by a frame mounted in a hermetic container. The frame is die cast using diamagnetic zinc having a high forming accuracy, thereby preventing an electromagnetic force of the linear motor from being leaked therethrough, and enabling a reduction in the number of machining times thereof after die casting.

10 Claims, 9 Drawing Sheets

LINEAR COMPRESSOR

BACKGROUND OF THE INVENTION

1. Field of the Invention

The present invention relates to a linear compressor and, more particularly, to a linear compressor having a zinc die-cast frame.

2. Description of the Related Art

Generally, a linear compressor is an apparatus to compress operating fluid, such as refrigerant, in a cylinder while reciprocating a piston in the cylinder using a reciprocating driving force of a linear motor.

FIG. 1 is a sectional view of a conventional linear compressor.

As shown in FIG. 1, the conventional linear compressor includes a hermetic container 2 to and from which operating fluid is introduced and discharged, and a compression unit mounted in the hermetic container 2 and adapted to compress the operating fluid.

The hermetic container 2 is provided with a fluid suction pipe 4 to introduce the operating fluid into a cylinder 10 of the compression unit, and a fluid discharge pipe 6 to discharge the operating fluid, compressed in the cylinder 10, to the outside of the hermetic container 2.

The compression unit includes the cylinder 10 configured to receive the operating fluid from the fluid suction pipe 4 provided at the hermetic container 2, a piston 20 mounted to be linearly reciprocated in the cylinder 10 to thereby compress the operating fluid in the cylinder 10, and a linear motor 30 to reciprocate the piston 20.

To the cylinder 10 is coupled a discharge unit 12 including a discharge valve 12'. The discharge unit 12 serves to discharge the compressed operating fluid from the cylinder 10 into the fluid discharge pipe 6.

The piston 20 is internally formed with a fluid passage 20' to pass the operating fluid introduced from the fluid suction pipe 4 therethrough. A suction valve 22 is coupled to the piston 20 to introduce the operating fluid of the fluid passage 20' into the cylinder 10.

The linear motor 30 is generally divided into a stator 32, and a mover 34 connected to the piston 20 and adapted to be reciprocated via electromagnetic interaction with the stator 32.

Meanwhile, the hermetic container 2 is internally provided with a frame 40 to support the cylinder 10 and the linear motor 30, a linear motor cover 42, and a plurality of dampers 44, 45, 46, and 47 to elastically support the frame 40 and the linear motor cover 42.

Conventionally, the frame 40 is integrally die cast with the cylinder 10 using paramagnetic aluminum.

The die-cast frame 40 and cylinder 10 have a low forming accuracy due to the nature of aluminum. For this reason, after die casting, the frame 40 and the cylinder 10 are machined, i.e. are lathed, on at least several locations a to i shown in FIG. 2 in a state wherein they are caught by a chuck.

In this case, specific parts of both the frame 40 and the cylinder 10, caught by the chuck, cannot be machined. In order to machine the overall parts of the die-cast frame 40 and cylinder 10, therefore, the frame 40 and the cylinder 10 must be machined at least two times.

Alternatively, one might propose that the frame 40 be independently die cast using aluminum and, then, be integrally coupled to the cylinder 10. However, even in the case of the independently die-cast frame 40, it must be machined on at several locations a to e shown in FIG. 3.

Now, the operation of the conventional linear compressor configured as stated above will be explained in detail.

If the linear motor 30 is driven, the piston 20 is reciprocated in the cylinder 10 using a driving force of the linear motor 30. Then, the discharge valve 12' and the suction valve 22 are repeatedly opened or closed as they cooperate with the reciprocating piston 20.

Thereby, the operating fluid is introduced into the cylinder 10 through the fluid suction pipe 4 and the fluid passage 20' in succession, thereby being compressed in the cylinder 10 by the piston 20 into a high-pressure fluid. Finally, the high-pressure operating fluid, compressed in the cylinder 10, is discharged out of the hermetic container 2 through the discharge unit 12 and the fluid discharge pipe 6 in succession.

The introduction, compression, and discharge of the operating fluid as stated above are continuously repeated in that order so long as the linear motor 30 is driven.

However, the conventional linear compressor as stated above has a problem in that the electromagnetic force of the linear motor 30 may be leaked through the frame 40 because the frame 40, used to support the linear motor 30, is made of aluminum. This leakage of the electromagnetic force results in a deterioration in the efficiency of the linear motor 30.

Also, since the die-cast frame 40 and cylinder 10 must be machined on a plurality of locations, they are disadvantageous in view of productivity and manufacturing costs.

SUMMARY OF THE INVENTION

Therefore, the present invention has been made in view of the above problems, and it is an object of the present invention to provide a linear compressor capable of preventing an electromagnetic force of a linear motor from being leaked via a motor supporting frame.

It is another object of the present invention to provide a linear compressor capable of minimizing the number of required machining locations of a die-cast frame.

In accordance with a first aspect of the present invention, the above and other objects can be accomplished by the provision of a linear compressor comprising: a frame; a cylinder supported by the frame; a piston mounted in the cylinder to be reciprocated therein; and a linear motor supported by the frame and adapted to reciprocate the piston, and the frame may be made of a diamagnetic material.

Preferably, the frame may be made of zinc selected from among diamagnetic materials.

Preferably, the frame may be formed via a die casting method.

Preferably, shock-absorbing members may be interposed between the frame and the linear motor.

Preferably, the shock-absorbing members may take the form of fine bosses formed at the frame.

Preferably, the cylinder may be integrally formed with the frame.

Preferably, the cylinder may be integrated with the frame as it is inserted into the frame simultaneously with the forming of the frame.

Preferably, the cylinder may have a stopper groove formed at a region that comes into contact with the frame so that a stopper protrusion of the frame is inserted into the stopper groove.

Preferably, the cylinder may be provided with a discharge unit to discharge compressed operating fluid from the cylinder, and a cylinder cover, made of a diamagnetic material, may be interposed between the cylinder and the discharge unit.

Preferably, the cylinder may be fitted into the frame after completing the forming of the frame.

Preferably, the linear compressor may further comprise a linear motor cover to support the linear motor at an opposite side of the frame, and the linear motor cover may be made of a diamagnetic material.

Preferably, the linear motor cover may be die cast using zinc.

In accordance with a second aspect of the present invention, the above and other objects can be accomplished by the provision of a linear compressor comprising: a frame; a cylinder supported by the frame; a piston mounted in the cylinder to be reciprocated therein; a linear motor supported by the frame and adapted to reciprocate the piston; and a linear motor cover to support the linear motor at an opposite side of the frame, and the frame and the linear motor cover may be die cast using zinc.

Preferably, shock-absorbing members, taking the form of fine bosses, may be interposed between the frame and the linear motor.

Preferably, the cylinder may be integrally formed with the frame.

Preferably, the cylinder may be integrated with the frame as it is inserted into the frame simultaneously with the forming of the frame.

Preferably, the cylinder may have a stopper groove formed at a region that comes into contact with the frame so that a stopper protrusion of the frame is inserted into the stopper groove.

Preferably, the cylinder may be provided with a discharge unit to discharge compressed operating fluid from the cylinder, and a cylinder cover, made of a diamagnetic material, may be interposed between the cylinder and the discharge unit.

Preferably, the cylinder may be fitted into the frame after completing the forming of the frame.

In accordance with a third aspect of the present invention, the above and other objects can be accomplished by the provision of a linear compressor comprising: a cylinder into which operating fluid is introduced; a discharge unit provided at the cylinder; a cylinder cover interposed between the discharge unit and the cylinder and made of a diamagnetic material; a piston mounted to be reciprocated in the cylinder to compress the operating fluid in the cylinder to thereby discharge the compressed operating fluid into the discharge unit; a linear motor to reciprocate the piston; a frame to support the cylinder and the linear motor and having shock-absorbing members taking the form of fine bosses formed at a surface thereof facing the linear motor; and a linear motor cover to support the linear motor at an opposite side of the frame, and the frame and the linear motor cover may be die cast using zinc.

In the linear compressor of the present invention configured as stated above, the frame is die cast using the diamagnetic material, effectively preventing an electromagnetic force of the linear motor from being leaked through the frame. In particular, when the frame is die cast using zinc that is particularly selected from among diamagnetic materials, it has the effect of improving a forming accuracy of the frame.

BRIEF DESCRIPTION OF THE DRAWINGS

The above and other objects, features and other advantages of the present invention will be more clearly understood from the following detailed description taken in conjunction with the accompanying drawings, in which.

Figure 7:
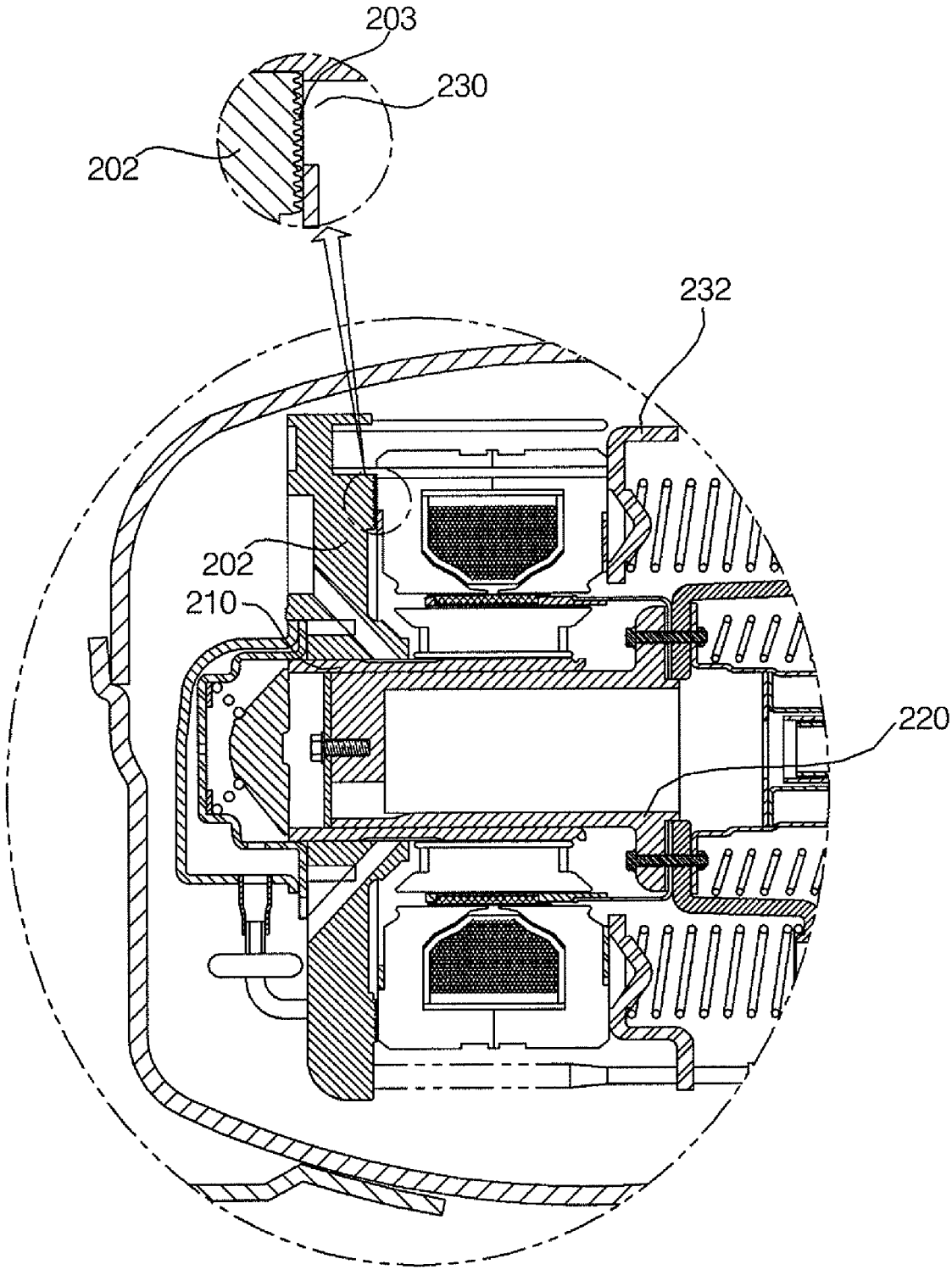
Figure 8:
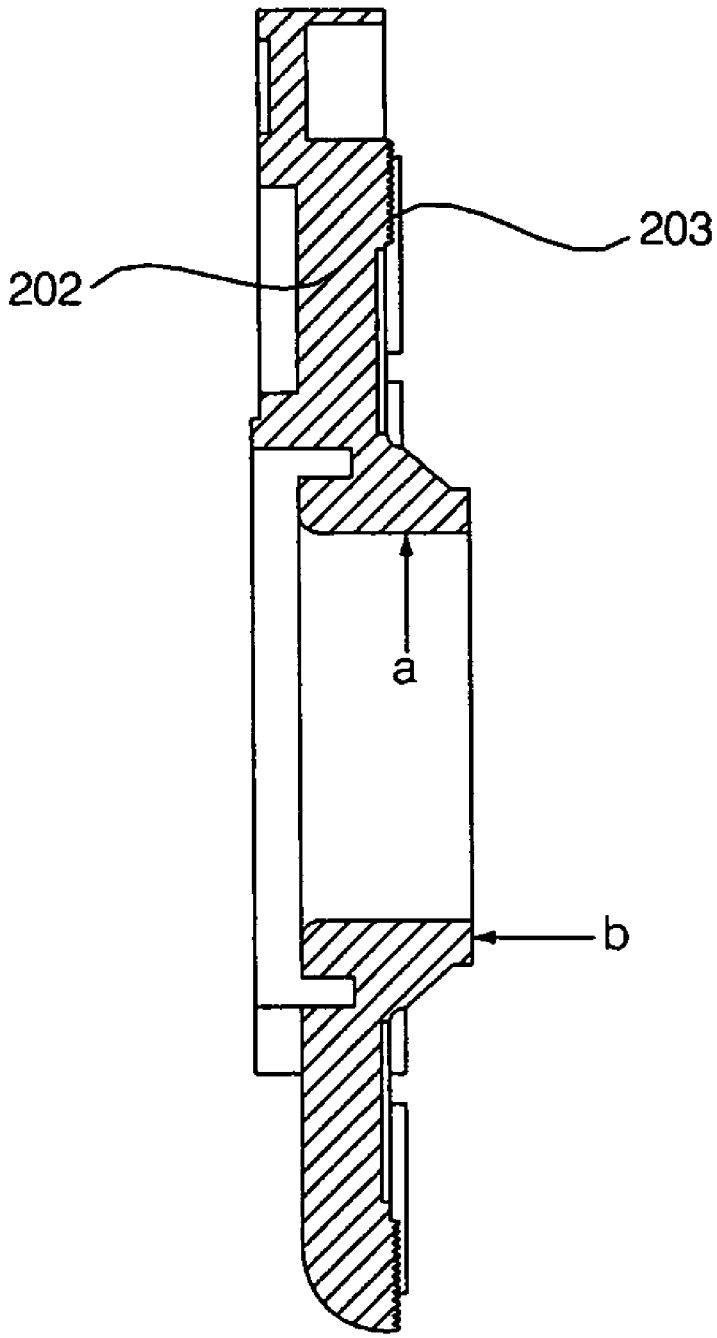

FIG. **6*a*** is a sectional view illustrating a linear compressor according to the second embodiment of the present invention;

FIG. 7 is an enlarged sectional view illustrating important parts of the linear compressor according to a third embodiment of the present invention; and FIG. 8 is an enlarged sectional view illustrating machining locations of the important parts of the linear compressor according to the third embodiment of the present invention.

DESCRIPTION OF THE PREFERRED EMBODIMENTS

Now, a linear compressor according to the present invention will be described with reference to the accompanying drawings.

For reference, there may be provided several preferred embodiments of the linear compressor according to the present invention, and hereinafter, the most preferred embodiment will be explained. The basic structure of the linear compressor is identical to the above described prior art and, thus, a detailed description thereof will be omitted.

Figure 1:
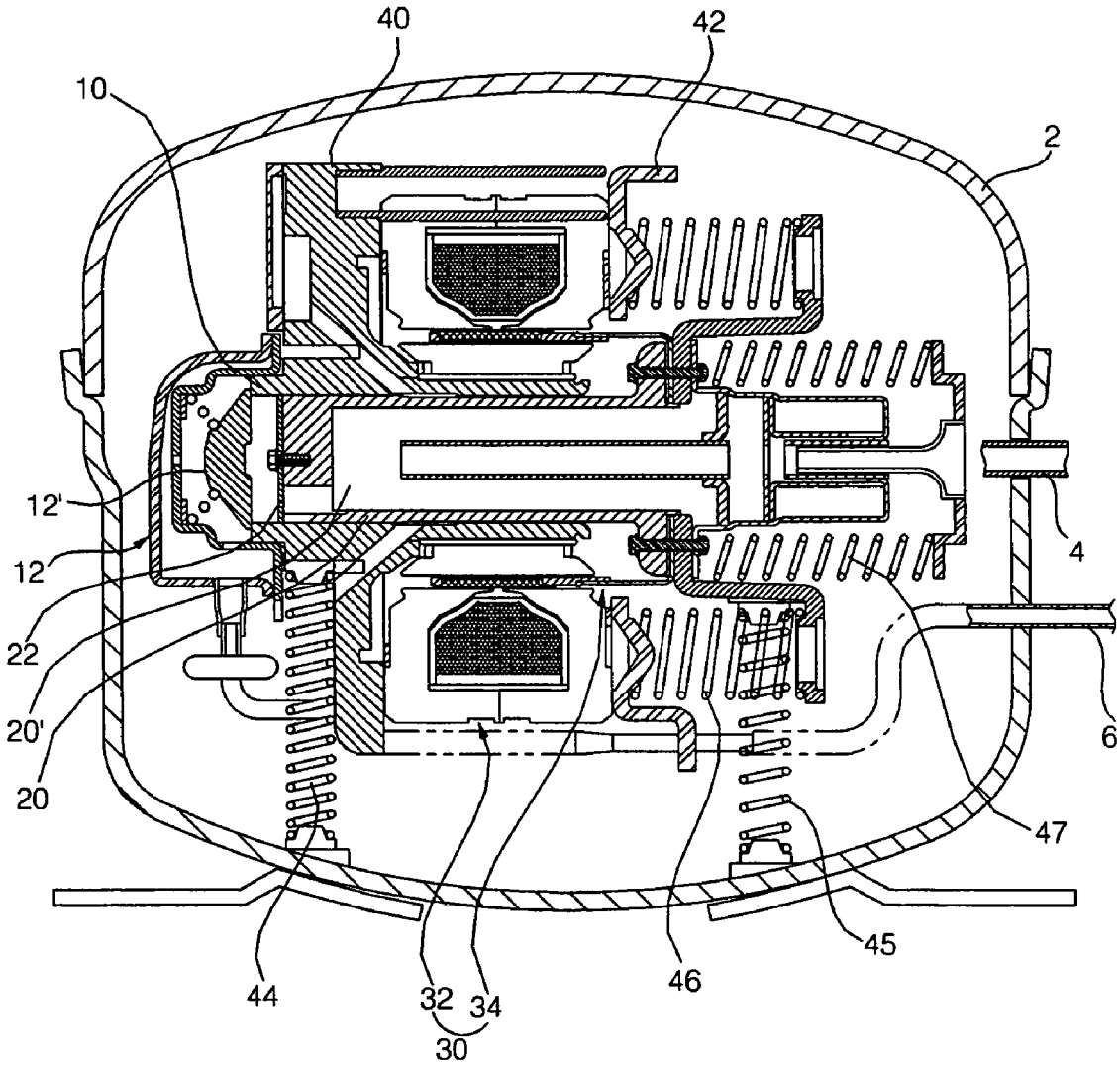
FIG. 1 (Prior Art)
FIG. 1 is a sectional view of a conventional linear compressor.
Figure 2:
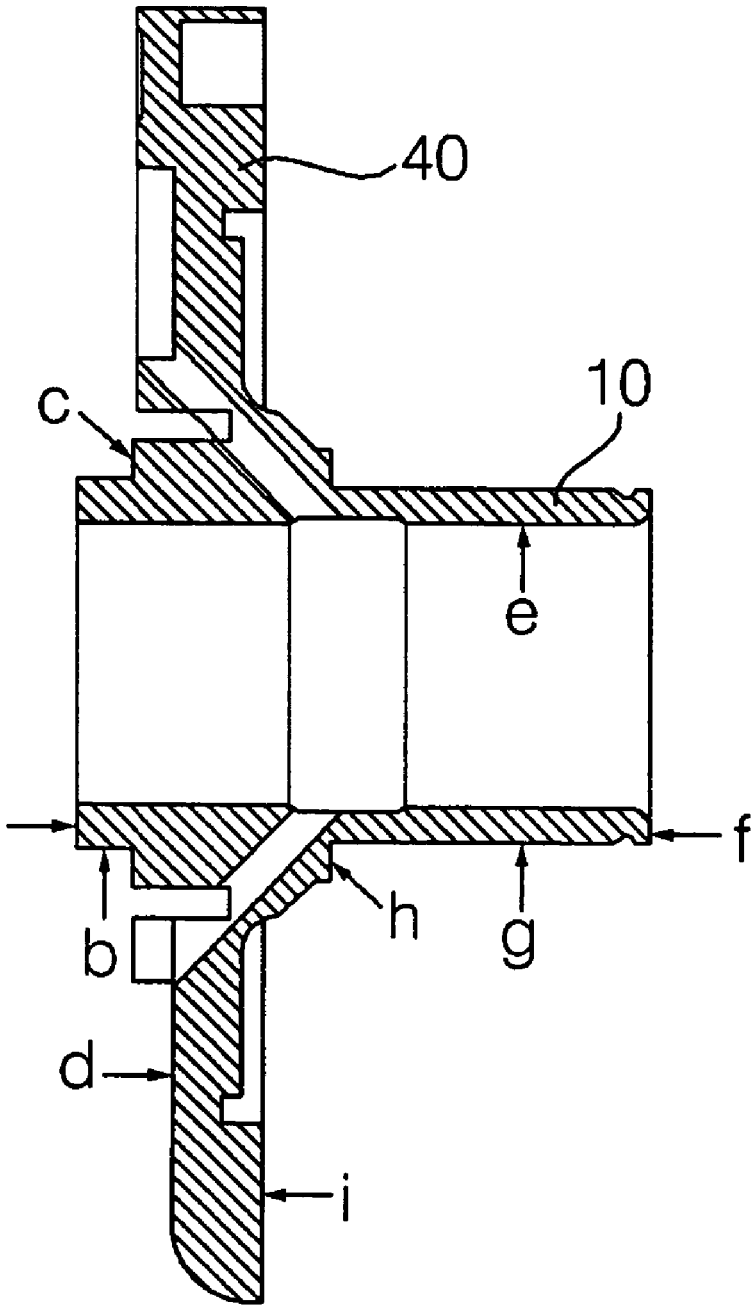
FIG. 2 (Prior Art)
FIG. 2 is an enlarged sectional view illustrating machining locations of important parts of the conventional linear compressor.
Figure 3:
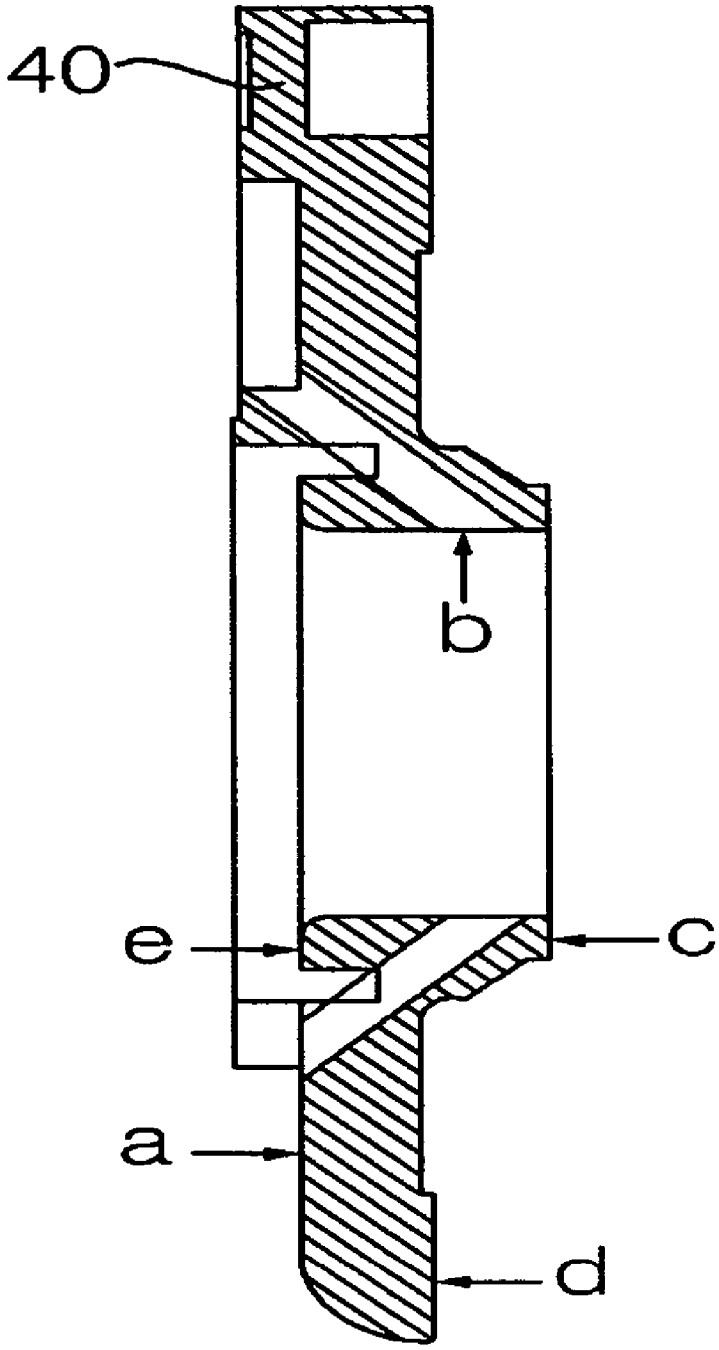
FIG. 3 (Prior Art)
FIG. 3 is an enlarged sectional view illustrating machining locations of important parts of another conventional linear compressor.
Figure 4:
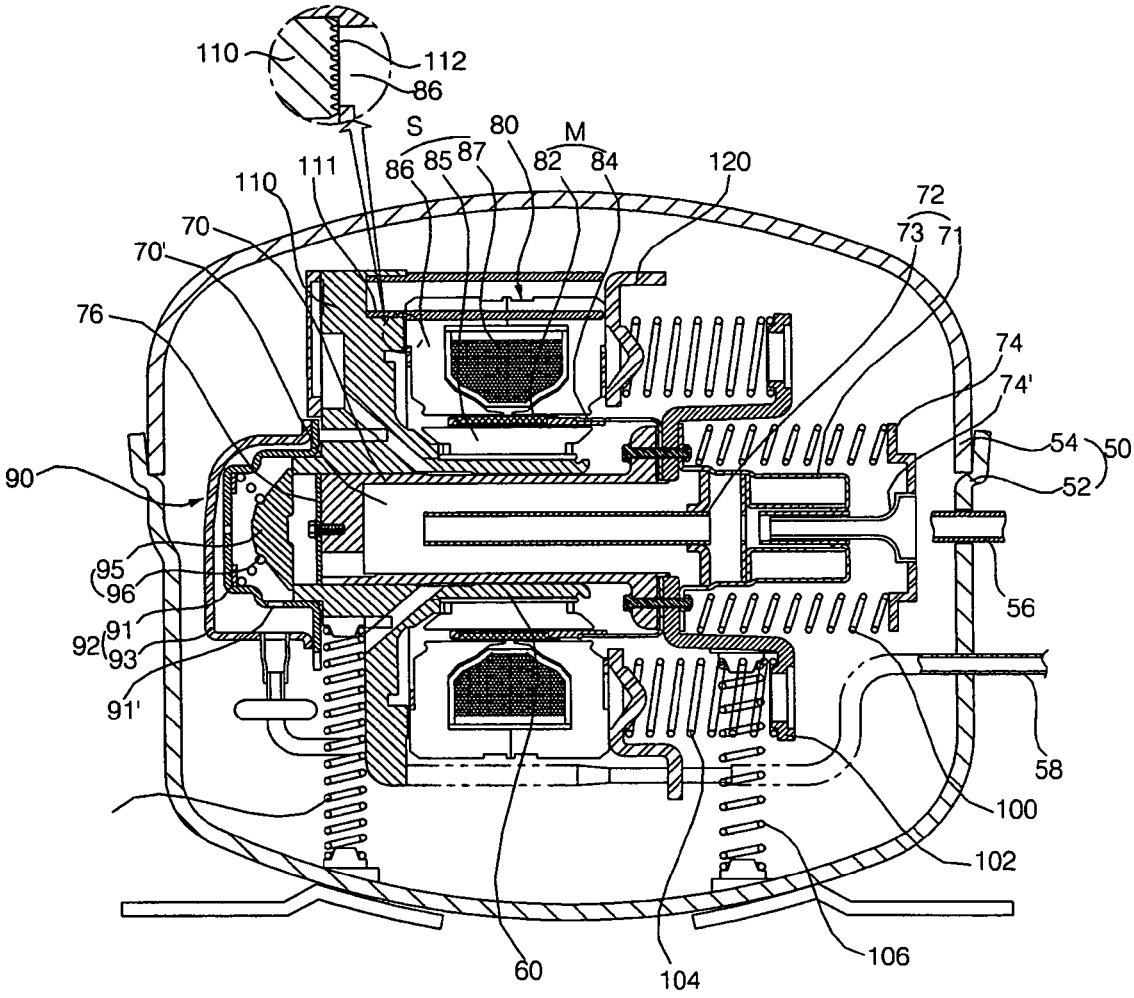
FIG. 4 is a sectional view illustrating a linear compressor according to a first embodiment of the present invention.

FIG. 4 is a sectional view illustrating a linear compressor according to a first embodiment of the present invention.

As shown in FIG. 4, the linear compressor according to the first embodiment of the present invention comprises a hermetic container 50, and a compression unit mounted in the hermetic container 50 and adapted to compress operating fluid.

The hermetic container 50 is divided into a lower shell 52 having an open upper surface, and an upper shell 54 to cover the upper surface of the lower shell 52.

The hermetic container 50 is provided with a fluid suction pipe 56 to introduce exterior operating fluid into the compression unit, and a fluid discharge pipe 58 to discharge the operating fluid, compressed in the compression unit, to the outside of the hermetic container 50.

The compression unit includes a cylinder 60 in which the operating fluid is compressed, a piston 70 mounted to be linearly reciprocated in the cylinder 60 to compress the operating fluid in the cylinder 60, and a linear motor 80 connected to the piston 70 to reciprocate the piston 70.

The cylinder 60 has a hollow cylindrical shape, and is open at opposite ends thereof so that the piston 70 is inserted into the cylinder 60 through one of the open ends of the cylinder, i.e. an entrance of the cylinder 60, while the operating fluid, compressed in the cylinder 60, is discharged from the cylinder 60 through the other end, i.e. an exit of the cylinder 60.

At the exit of the cylinder 60 is provided a discharge unit 90 to discharge the compressed operating fluid from the cylinder 60 into the fluid discharge pipe 58.

The discharge unit 90 includes a discharge cover assembly 92 configured to cover the exit of the cylinder 60 and connected to the fluid discharge pipe 58, and a discharge valve 94 mounted on the inward side of the discharge cover assembly 92 to open or close the exit of the cylinder 60.

The discharge cover assembly 92 consists of an inner discharge cover 91, and an outer discharge cover 93. The inner discharge cover 91, located around the discharge valve 94, is formed with a fluid hole 91'. The outer discharge cover 93 is located around the inner discharge cover 91 and is connected to the fluid discharge pipe 58.

The discharge valve 94 includes a discharge valve body 95 mounted at the exit of the cylinder 60, and a discharge valve spring 96 mounted between the discharge valve body 95 and the inner discharge cover 91 to elastically support the discharge valve body 95.

The piston 70 is internally formed with a fluid passage 70' to pass the operating fluid, introduced through the fluid suction pipe 56, therethrough.

The fluid passage 70' is connected at an entrance thereof to a muffler 72. The muffler 72 serves to guide the operating fluid from the fluid suction pipe 56 into the fluid passage 70' of the piston 70, and to attenuate flowing noise of the operating fluid.

The muffler 72 includes a muffler body 71 having a resonance space to attenuate the flowing noise of the operating fluid, and a muffler tube 73 to connect the muffler body 71 to the fluid passage 70' of the piston 70.

The muffler body 71 is supported by a back cover 74 located at an opposite side of the piston 70, and is connected to the fluid suction pipe 56 through a back cover pipe 74' provided in the back cover 74.

A first damper 100 may be provided between the back cover 74 and the piston 70. The first damper 100 is elastically deformable in a reciprocating movement direction of the piston 70.

At an exit of the fluid passage 70' is provided a suction valve 76 to open or close the fluid passage 70'.

The suction valve 76 is an elastic member fastened, at one side thereof, to the piston 70. The suction valve 86 serves to open or close the exit of the fluid passage 70' as it is elastically deformed by a pressure difference between the fluid passage 70' and the interior of the cylinder 60.

The linear motor 80 is generally divided into a mover M connected to the piston 70 to cooperate with the piston 70, and a stator S to electromagnetically interact with the mover M to reciprocate the mover M.

The mover M includes a magnet 82 radially and outwardly located around the cylinder 60 to be reciprocated in the stator S, and a magnet frame 84 coupled with both the magnet 82 and the piston 70 to cooperate with the piston 70.

The stator S includes an inner core 85 located between the magnet 82 and the cylinder 60, an outer core 86 radially and outwardly located around the mover M, and a coil 87 provided in the outer core 86 to produce a magnetic field.

A second damper 104 may be provided between the linear motor 80 and a spring seat 102 that is coupled to the piston 70. The second damper 104 is elastically deformable in the reciprocating movement direction of the piston 70. Also, a third damper 106 may be provided between the spring seat 102 and the lower shell 52 to be elastically deformed in a vertical direction.

Meanwhile, the hermetic container 50 is internally provided with a frame 110. The frame 110 is integrally formed with the cylinder 60 and is used to support the compression unit including the cylinder 60 and the linear motor 80.

The frame 110 is configured to come into contact with the outer core 86 of the linear motor 80 in order to support the linear motor 80. Thus, the frame 110 is integrally formed with the cylinder 60 using a diamagnetic material to prevent an electromagnetic force produced between the mover M and the stator S of the linear motor 80 from being leaked via the frame 110.

Examples of the diamagnetic material include gold, silver, zinc, copper, chrome, etc. Preferably, the frame 110 is integrally formed with the cylinder 60 using zinc, which is one of the least expensive diamagnetic materials, and has a high forming accuracy.

In this case, both the frame 110 and the cylinder 60, formed of zinc, may be manufactured using a hot chamber die casting method.

Figure 5:
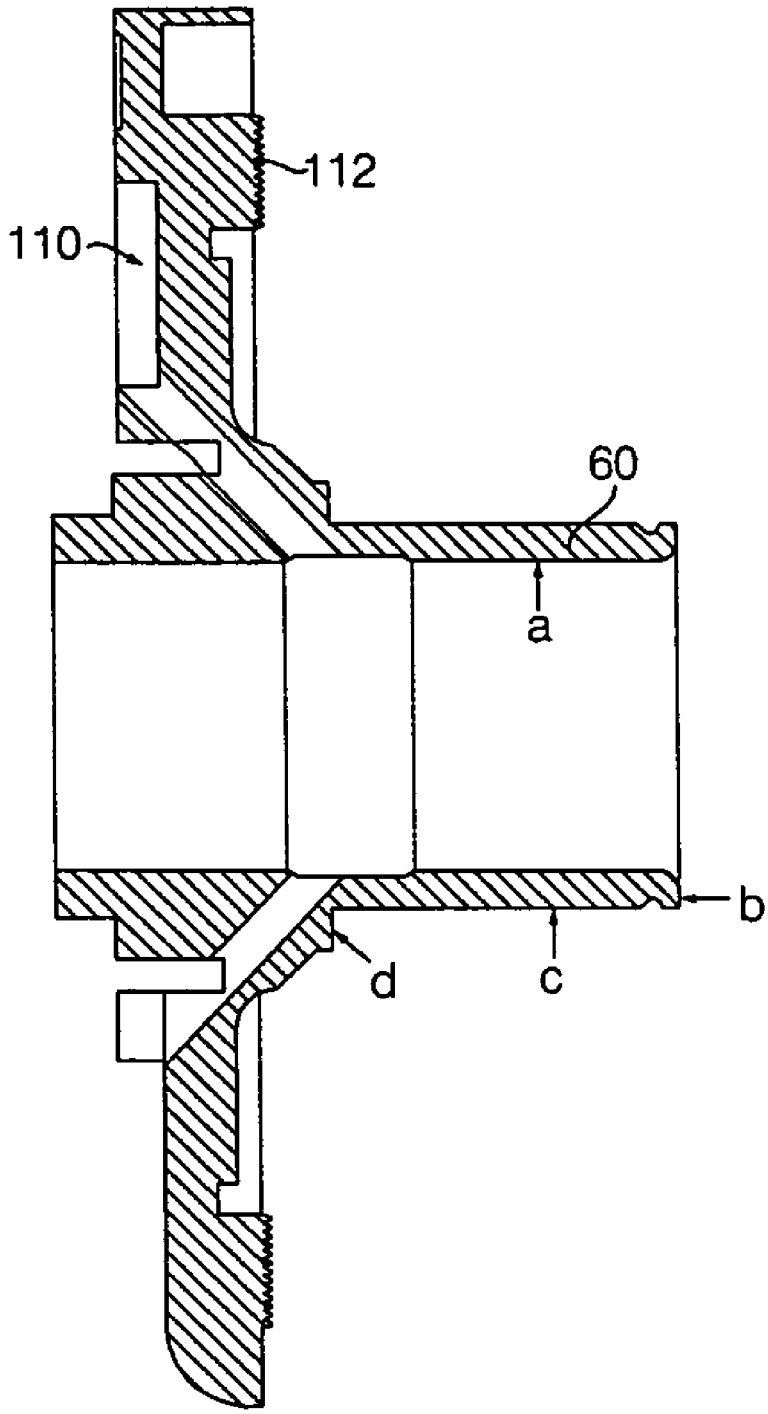
FIG. 5 is an enlarged sectional view illustrating machining locations of important parts of the linear compressor according to the first embodiment of the present invention.

In the present invention, since the integrally die-cast zinc frame 110 and cylinder 60 have the high forming accuracy, after die casting, the frame 110 and the cylinder 50 are machined on only limited locations a to d shown in FIG. 5.

The die-cast frame 110 is integrally coupled to the linear motor 80 by means of fastening members 111, such as bolts or rivets, so that it partially comes into contact with the outer core 86 of the linear motor 80. A fourth damper 108 may be provided between the frame 110 and the lower shell 52 to support the frame 110 as it is elastically deformed in the vertical direction.

Also, between the frame 110 and the outer core 86 of the linear motor 80 may be interposed shock-absorbing members 112. The shock-absorbing members 112 are able to prevent the cylinder 60 from being deformed by a force applied to the frame 110 when the frame 110 is coupled to the linear motor 80.

The shock-absorbing members 112 take the form of fine bosses integrally formed with the frame 110 to protrude from the frame 110 toward the outer core 86 of the linear motor 80. When the frame 110 is coupled to the linear motor 80, the shock-absorbing members 112 are collapsed or deformed to have a concave shape, serving to absorb the force applied to the frame 110.

Meanwhile, the hermetic container 50 is internally provided with a linear motor cover 120 to support the linear motor 80 along with the frame 110.

Similar to the frame 110, the linear motor cover 120 is preferably die cast using zinc.

The die-cast linear motor cover 120 is fastened to the linear motor 80 so that it comes into contact with the outer core 86 of the linear motor 80.

Now, the operation of the linear motor 80 in accordance with the first embodiment of the present invention configured as stated above will be explained.

If the linear motor 80 is driven, the mover M of the linear motor 80 electromagnetically interacts with the stator S to thereby be reciprocated, thereby causing the piston 70 to be reciprocated in the cylinder 60. Then, the suction valve 76 and the discharge valve 94 are repeatedly opened and closed as they cooperate with the reciprocating piston 70.

Thereby, the operating fluid is introduced into the cylinder 60 to be compressed therein and, then, is discharged out of the cylinder 60. The introduction, compression, and discharge of the operating fluid are continuously repeated so long as the linear motor 80 is driven.

In this case, since the cylinder 60, frame 110, and linear motor cover 120, which come into contact with the linear motor 80, are made of the diamagnetic material, they have no risk of leakage of the electromagnetic force from the linear motor 80. This can maximize the efficiency of the linear motor 80. In other words, the linear motor can exhibit the maximum capability thereof.

In the following description of second and third embodiments of the present invention, the detailed description of parts identical to those of the first embodiment of the present invention may be omitted. Thus, the omitted parts must be understood with reference of the above description of the first embodiment related to FIG. 4.

Figure 6A:
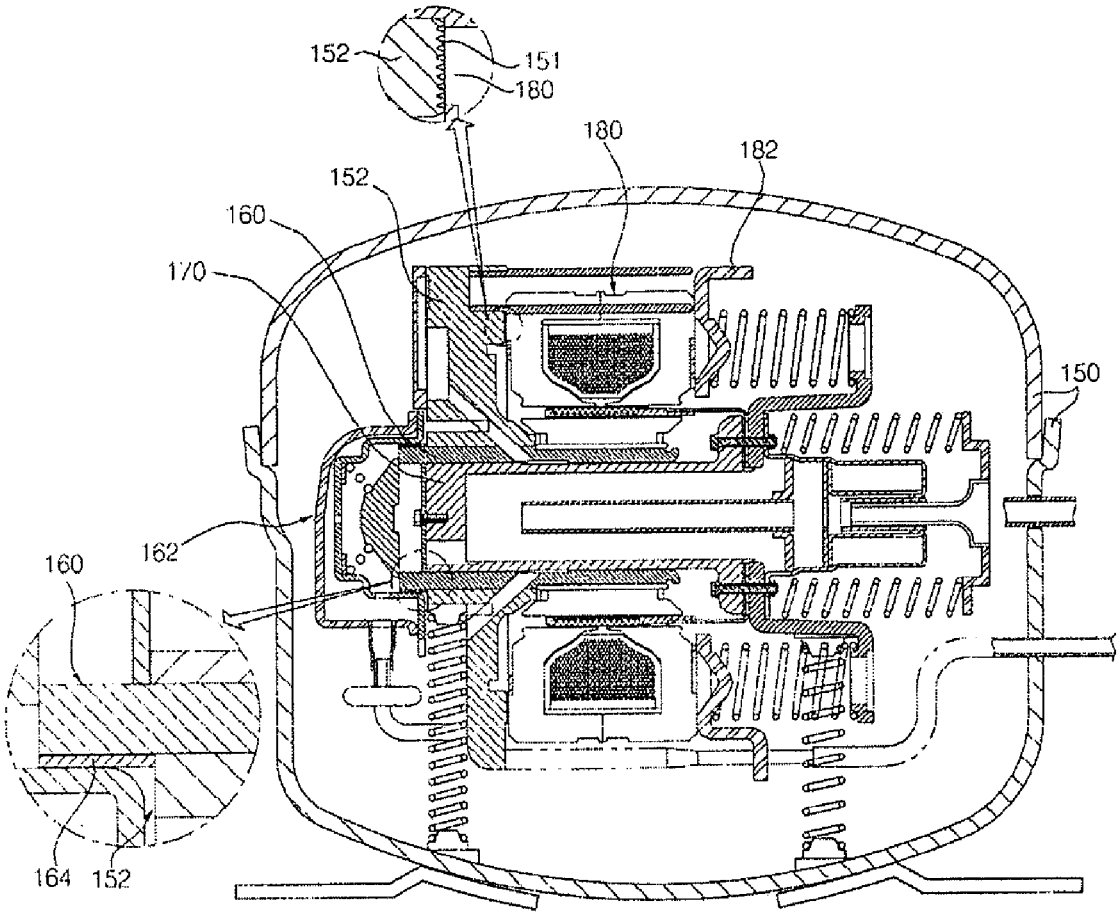
Figure 6B:
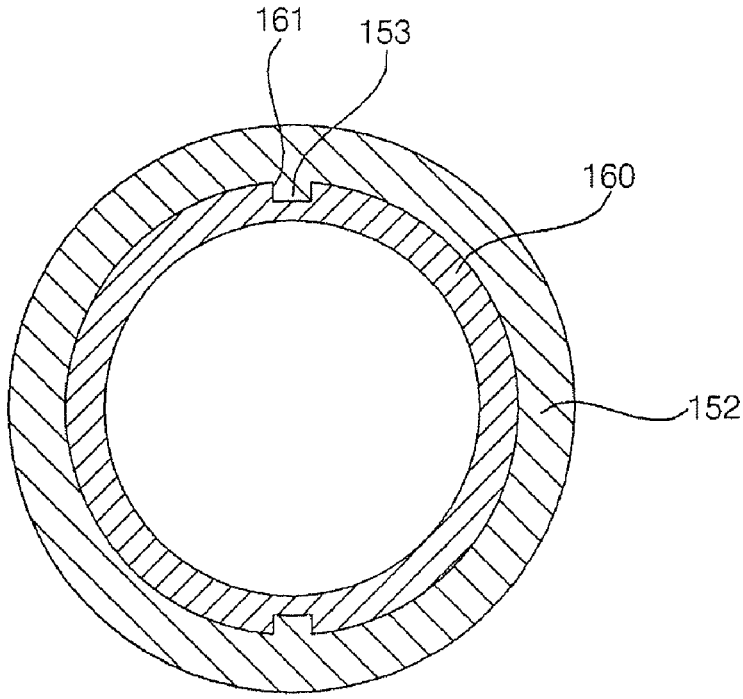
Figure 6C:
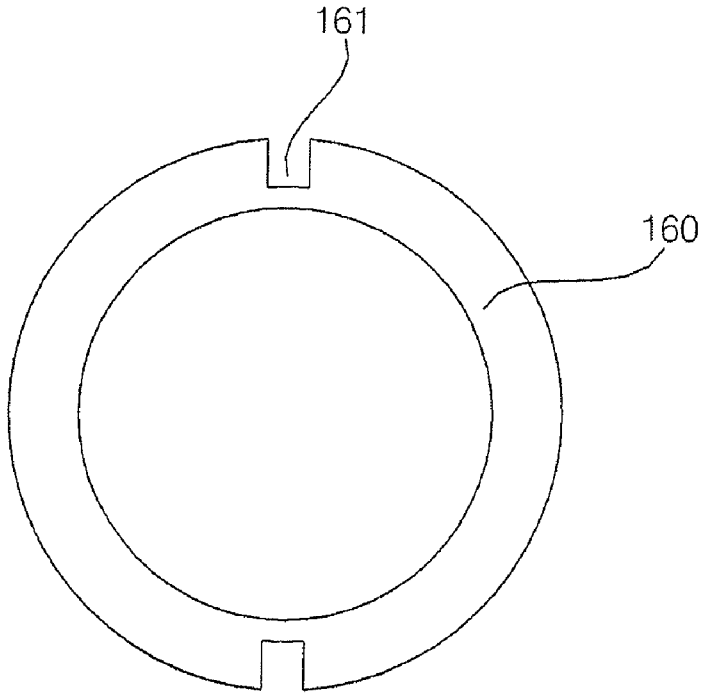

FIG. 6*a* is a sectional view illustrating a linear compressor according to a second embodiment of the present invention;

FIG. 6*b* is a cross sectional view through the cylinder and frame;

FIG. 6*c* is a cross sectional view of the cylinder;

The linear compressor of the present embodiment comprises a frame 152, a cylinder 160, a piston 170, and a linear motor 180, which are mounted in a hermetic container 150. The cylinder 160 is integrally coupled to the frame 152 as it is inserted into the frame 152 simultaneously with the forming of the frame 152. The cylinder 160 is provided with a discharge unit 162. The piston 170 is mounted to be reciprocated in the cylinder 160 under the operation of the linear motor 180, which is supported by the frame 152.

The frame 152 has a ring shape so that the cylinder 160 is located in the center thereof. The frame 152 is provided with shock-absorbing members 151 at a region thereof that comes into contact with the linear motor 180. Similar to the above described first embodiment, the shock-absorbing members 151 take the form of fine bosses suitable to absorb a force transmitted to the frame 152 when the frame 152 is coupled to the linear motor 180.

The frame 152, configured as stated above, is die cast using zinc and, after die casting, is machined on only one or two locations thereof.

The cylinder 160 may be cast using steel, which has a high durability to endure a frictional force caused between the cylinder 160 and the piston 170.

The cast cylinder 160 is inserted into the frame 152 simultaneously with the forming of the frame 152. With this configuration, it is unnecessary to machine part of the cylinder 160 that comes into contact with the frame 152. Admittedly, the remaining part of the cylinder 160 may be machined on several locations so that the piston 170 and the linear motor 180 can be smoothly coupled to the cylinder 160.

With the above described configuration, since the cylinder 160 is separately formed from the frame 152 and, then, is inserted into the frame 152 simultaneously with the forming of the frame 152, the compressed operating fluid, discharged from the cylinder 160 into the discharge unit 162, may be leaked into a gap between the cylinder 160 and the frame 152, or the cylinder 160 may be unintentionally separated from the frame 152.

To prevent separation between the cylinder 160 and the frame 152, the cylinder 160 may be formed with a stopper groove 161 at a region that comes into contact with the frame 152, while the frame 152 may be formed with a stopper protrusion 153 to be inserted into the stopper groove 161. The frame having the protrusion 153 fitting within the groove 161 is seen in the cross sectional view of FIG. 6*b*. The stopper groove 161 is formed at the cylinder 160 via a knurling process after the cylinder 160 is cast. A view of the cylinder and groove is seen in FIG. 6*c*.

Also, as a result of forming the cylinder 160, which comes into contact with a part of the linear motor 180, using a ferromagnetic steel to achieve high durability, the electromagnetic force of the linear motor 180 is guided to flow only toward the cylinder 160.

In this case, a cylinder cover 164, made of a diamagnetic material, may be provided between the cylinder 160 and the discharge unit 162 to prevent the leakage of the electromagnetic force of the linear motor 180. Since the frame 152 is made of diamagnetic zinc, the cylinder cover 164 is able to be integrally formed with the frame 152.

The linear motor 180 is able to be supported by a linear motor cover 182 that is located at an opposite side of the frame 152 about the linear motor 180.

The linear motor cover 182 is mounted to come into contact with a part of the linear motor 180. Thus, the linear motor cover 182 is preferably die cast using diamagnetic zinc.

FIG. 7 is a sectional view illustrating important parts of a linear compressor according to the third embodiment of the present invention.

In the linear compressor according to the third embodiment of the present invention, a ring shaped frame 202 is mounted in a hermetic container, and a cylinder 210 is fitted into the frame 202. Also, a piston 220 is mounted in the cylinder 210 in a linearly reciprocable manner, and a linear motor 230 is coupled to the frame 202 to reciprocate the piston 220.

The frame 202 is formed with shock-absorbing members 203 at a region thereof that comes into contact with the linear motor 230. Similar to the first and second embodiments, the shock-absorbing members 203 take the form of fine bosses to absorb shock caused when the frame 202 is coupled to the linear motor 230.

The frame 202 is die cast using zinc and, after die casting, is machined at only limited locations a and b shown in FIG. 8.

The cylinder 210 is able to be cast using steel to endure a frictional force caused between the cylinder 210 and the piston 220. In the case of the cast cylinder 210, it must be machined on at least several locations that come into contact with the frame 202, piston 220, and linear motor 230 for achieving a high forming accuracy.

The linear motor 230 is able to be supported by a linear motor cover 232 that is located at an opposite side of the frame 202 about the linear motor 230.

The linear motor cover 232 is also preferably die cast using zinc.

As is apparent from the above description, a linear compressor according to the present invention has the following effects.

Firstly, according to the present invention, a frame, which serves to support a cylinder and a linear motor, is die cast using a diamagnetic material. This effectively prevents an electromagnetic force of the linear motor from being leaked via the frame, resulting in an improvement in the efficiency of the linear motor and, consequently, the efficiency of the linear compressor.

Secondly, the frame is die cast using zinc, which is particularly selected from among all diamagnetic materials due to a high forming accuracy thereof. As compared to a conventional aluminum frame, the die-cast zinc frame can be reduced in the number of locations to be machined after die casting, achieving improved productivity and reduced manufacturing costs.

Thirdly, according to the present invention, shock-absorbing members are interposed between the frame and the linear motor. With the use of the shock-absorbing members, it is possible to prevent deformation of the cylinder due to a force transmitted to the frame when the frame is coupled to the linear motor.

Fourthly, since a linear motor cover, which serves to support the linear motor along with the frame, is die cast using diamagnetic zinc, the leakage of the electromagnetic force of the linear motor through the linear motor cover can be effectively prevented, resulting in more improved efficiency of the linear motor.

Although the preferred embodiments of the present invention have been disclosed for illustrative purposes. those skilled in the art will appreciate that various modifications, additions and substitutions are possible, without departing from the scope and spirit of the invention as disclosed in the accompanying claims.

What is claimed is:

1. A linear compressor comprising:

a frame having a cylindrical portion and a collar extended outwardly from the cylindrical portion;

a cylinder inserted into the cylindrical portion of the frame, the cylinder having a protruding portion protruded from the cylindrical portion of the frame in a front direction of the cylinder;

a piston mounted in the cylinder to be reciprocated therein;

a linear motor supported by the collar of the frame and adapted to reciprocate the piston;

a discharge unit covering the end of the cylinder to receive a discharge valve and having a discharge hole to discharge compressed operating fluid from the cylinder, the discharge unit having a top, and a sidewall extending downwardly from the top, the sidewall having an inner surface and an outer surface; and a cylinder cover located in front of the cylindrical portion of the frame and interposed between the protruding portion of the cylinder and the inner surface of the discharge unit sidewall, an outer diameter of the cylinder cover being smaller than an outer diameter of the cylindrical portion of the frame, the cylinder cover being made of a diamagnetic material.

2. The compressor as set forth in claim 1, wherein the frame is made of zinc selected from among diamagnetic materials.

3. The compressor as set forth in claim 2, wherein the frame is formed via a die casting method.

4. The compressor as set forth in claim 1, wherein the cylinder is integrally formed with the frame.

5. The compressor as set forth in claim 1, wherein the cylinder is fitted into the frame after completing the forming of the frame.

6. The compressor as set forth in claim 1, further comprising a linear motor cover to support the linear motor at an opposite side of the frame, wherein the linear motor cover is made of a diamagnetic material.

7. The compressor as set forth in claim 6, wherein the linear motor cover is die cast using zinc.

8. The compressor as set forth in claim 1, wherein a plurality of fine bosses are formed on one side of the frame such that the fine bosses are deformed to absorb the force applied to the frame when an outer core of the linear motor is coupled to the frame.

9. The compressor as set forth in claim 1, wherein the cylinder has a stopper groove formed at an outer circumferential surface and a stopper protrusion is formed at an inner circumferential surface of the frame such that the stopper protrusion is inserted into the stopper groove.

10. The compressor as set forth in claim 1, further comprising a flange extending outwardly from the sidewall of the discharge unit.

* * * * *